US005692446A

United States Patent [19]

Becker et al.

[11] Patent Number: 5,692,446

[45] Date of Patent: Dec. 2, 1997

[54] METHOD AND ARRANGEMENT OF EQUIPMENT FOR THE PROTECTION OF BUILDINGS AND PEOPLE FROM ACTS OF VIOLENCE

[75] Inventors: Lothar Becker, Lichtenau-Blankenrode; Jurgen Zorn, Taufkirchen, both of Germany

[73] Assignee: Industrieanlagen-Betriebsgesellschaft mbH, Ottobrunn, Germany

[21] Appl. No.: 507,397

[22] PCT Filed: Feb. 25, 1994

[86] PCT No.: PCT/EP94/00564

§ 371 Date: Oct. 24, 1995

§ 102(e) Date: Oct. 24, 1995

[87] PCT Pub. No.: WO94/19571

PCT Pub. Date: Sep. 1, 1994

[30] Foreign Application Priority Data

Feb. 27, 1993 [DE] Germany ..... 43 06 187.7

[51] Int. Cl.[6] ..... E05G 5/02

[52] U.S. Cl. ..... 109/3; 109/20; 109/25; 109/32

[58] Field of Search ..... 109/2–8, 20, 25, 109/29–34, 63

[56] References Cited

U.S. PATENT DOCUMENTS

| | | | |
|---|---|---|---|
| 3,924,546 | 12/1975 | Pretini | 109/20 |
| 4,060,039 | 11/1977 | Lagarrigue | 109/3 |
| 4,385,469 | 5/1983 | Scheuerpflug et al. | 49/41 |
| 4,586,441 | 5/1986 | Zekich | 109/8 |
| 4,799,247 | 1/1989 | Annis et al. | 378/87 |
| 5,311,166 | 5/1994 | Frye | 109/20 X |

FOREIGN PATENT DOCUMENTS

| | | | |
|---|---|---|---|
| 0268924 | 6/1988 | European Pat. Off. | 109/3 |
| 2 561 299 A1 | 9/1985 | France . | |
| 25 39 779 A1 | 3/1977 | Germany . | |
| 29 03 114 | 7/1980 | Germany . | |

*Primary Examiner*—Lloyd A. Gall

*Attorney, Agent, or Firm*—Marshall, O'Toole, Gerstein, Murray & Borun

[57] ABSTRACT

The invention relates to a method, and the equipment necessary for implementation thereof, for the unnoticeable detection of armed persons in the region giving access to objects that require protection and for the detention of such persons by surprise. Detention by surprise prevents individuals prepared to do violence from being able to run amok or take hostages in order to secure their own release.

16 Claims, 3 Drawing Sheets

GE=X-ray generator
IS=X-ray sensor

CE = X-ray generator
IS = X-ray sensor

METHOD AND ARRANGEMENT OF EQUIPMENT FOR THE PROTECTION OF BUILDINGS AND PEOPLE FROM ACTS OF VIOLENCE

This invention relates to a method and an arrangement of equipment for the protection of buildings and people from acts of violence.

BACKGROUND OF THE INVENTION

The most similar existing methods for the continuous, routine monitoring of people and baggage are practiced, for example, at airports. The people are checked by means of hand-held metal detectors or by walking through a frame with the same action. The baggage contents are visualized by radiographic methods described in principle in U.S. Pat. No. 4 799 247. Monitoring methods of this kind, however, in principle have the disadvantage that a potential perpetrator is aware that they exist and knows the details of their nature, site and comprehensiveness. Therefore he can collaborate with third parties to position the weaponry in such a way that it can be retrieved unnoticed after he has been monitored.

A method by which a person carrying a concealed metal object can be detected and immediately thereafter detained by locking a revolving door in position has been described in OS 29 03 114. This method in principle has the disadvantage that the metal object is not identified with regard to how dangerous it might be, so that false outcomes are common; that is, people with large enough metal objects are detained even though they are harmless.

The problem is thus to provide a method in which, by several successive stages of purposeful measures, first the presence of a potentially dangerous object is detected, then this object is analyzed and if it is dangerous is so identified, the face of the person involved is documented before anything further is done, and the person is detained by surprise with no chance to resist and no danger to third parties. It is desirable to separate the sites of identification and of detention far enough in space that forewarning effects are minimized. This requires that the persons be labeled without their noticing and detained on the basis of this labeling, i.e. not necessarily on the basis of a physical measurement signal. In the concept of the method it is assumed that individuals with violent intent have previously reconnoitred the localities as harmless visitors.

SUMMARY OF THE INVENTION

The invention relates to a method, and to the arrangement of equipment necessary for the implementation thereof, for identifying persons intending violence as dangerous, by way of the weapons they are carrying, as soon as they enter buildings and for detaining them in such a way that they have no opportunity to secure their release by extortion, e.g. by taking hostages. The determination that one or more weapons is or are being brought into the building, the identification of the weaponry and the labeling of the armed persons to target them for detention all occur undetectably; therefor the potential perpetrator can be detained by surprise. The invention is meant to be used primarily in cases such that protection is required for buildings and the people therein but visible check-points are unsuitable because of their forewarning effect, or in which potential perpetrators do not expect such controls, at least not in the outermost entrance region.

DETAILED DESCRIPTION

Figure 1:
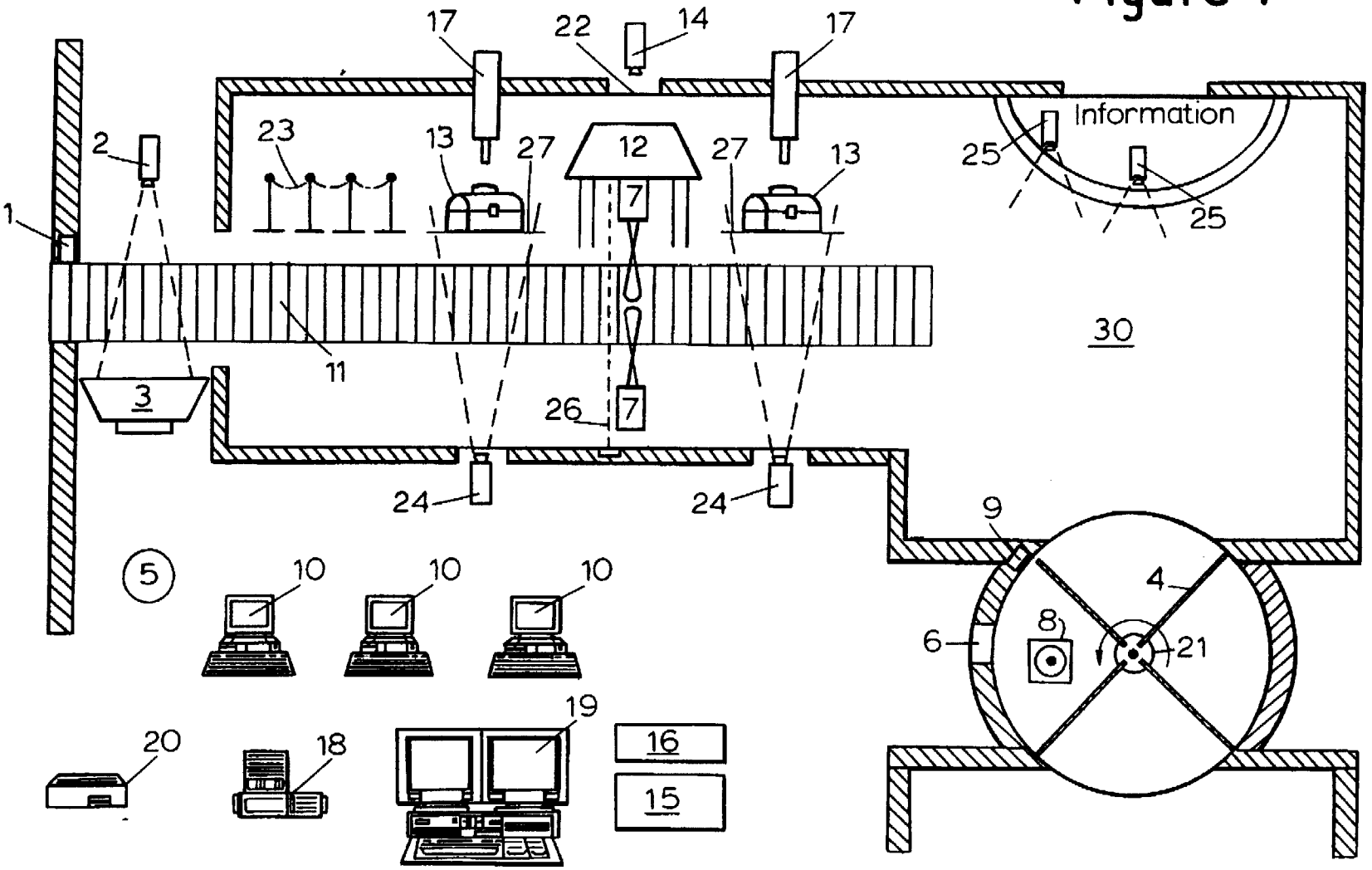
FIG. 1 is a schematic view illustrating a building interior protected in accordance with the present invention from people intending acts of violence.

The method in accordance with the invention provides for the following procedures:

At the entrance to a vestibule 30 of the building to be secured, suitable means are provided to cause entering individuals to proceed singly, so that at least one first sensor/metal-detector 1 can be used to determine whether relatively large metal objects are being brought in by a given individual. This test is performed in real time, and a positive result causes a signal to be sent to the security staff in the guard room 5. The metal detector 1 is extremely sensitive and is capable of identifying the kinds of metal by the signals it receives; as a result, false alarms caused, e.g., by coins, keys or jewelry are prevented (FIG. 1).

Instead of one metal detector, a number of metal detectors can be provided at various heights, incorporated for example in a doorway. These detectors make it possible to determine precisely the height and the position of the detected metal object, and to indicate whether several metal objects may be present.

Figure 2:
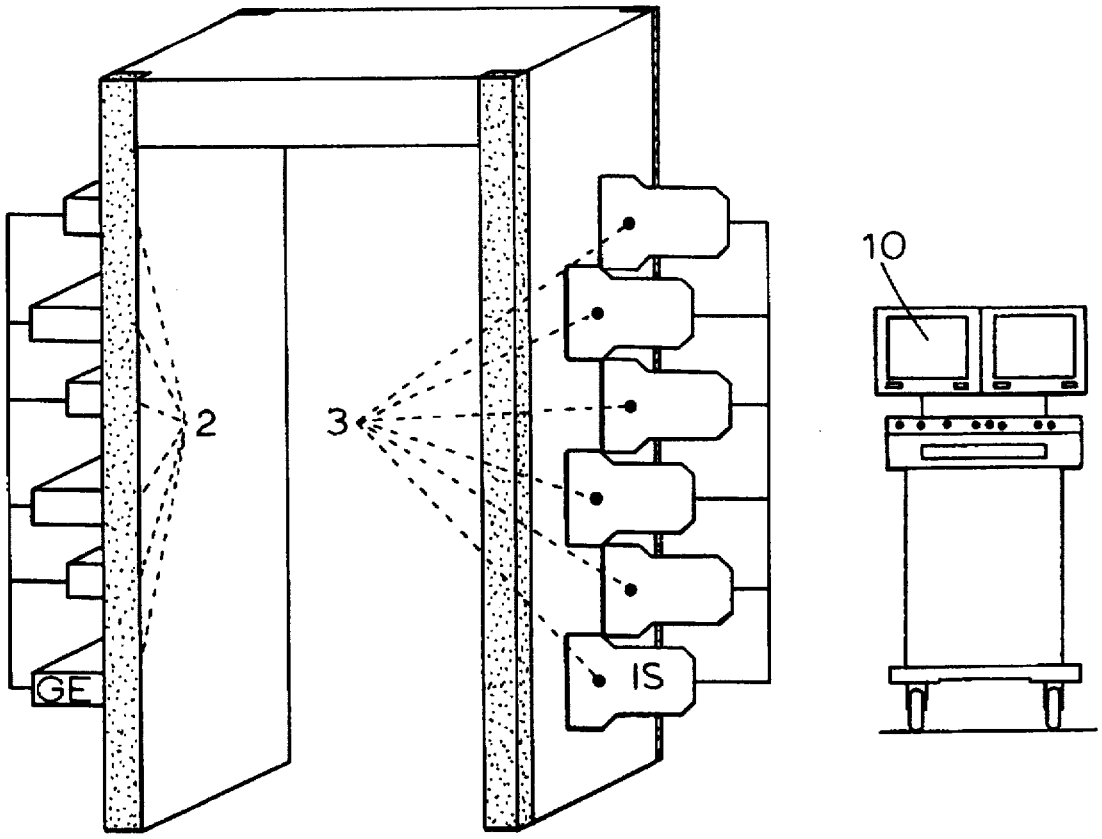
FIG. 2 is a schematic view illustrating X-ray machinery for identifying metal objects.

After a signal has been sent out by the metal detector(s), a further procedure is initiated immediately in order to verify and where appropriate to identify the metal objects. This can usefully be accomplished, for example, by radiography with an X-ray machine 2, 3, which for the present purpose can be done with a very low radiation dose. The X-ray picture is evaluated and analyzed immediately by security staff observing monitors 10. If an array of metal detectors at different heights is present, it is particularly advantageous to employ a similar array of X-ray generators 2 and sensors 3, each with its own display unit 10 (FIG. 2).

When a metal detector 1 in a particular height range has detected a potentially dangerous metal object, the X-ray generator 2 in the same height range is activated.

Figure 3:
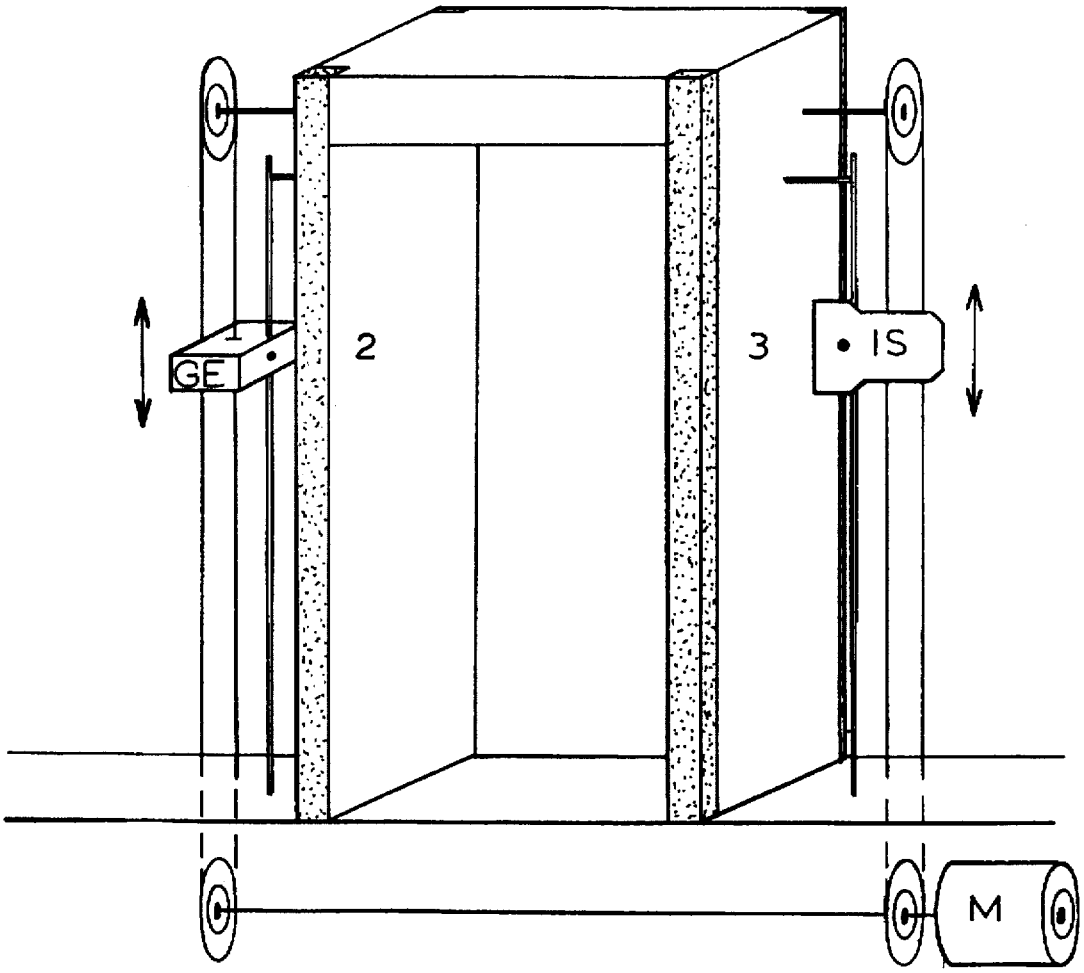
FIG. 3 is a schematic view illustrating movable X-ray machinery for identifying metal objects.

FIG. 3 shows a solution that requires less equipment. If a metal detector 1 has located a metal object at a particular height, then an X-ray generator 2 is moved to the height in question. With this solution, however, in case several metal objects are present at different heights and the individual is moving quickly, system saturation cannot be ruled out. Therefore it is useful to employ an additional video recorder 20, the recording from which can be replayed at slower speed or even frame by frame.

If the observing security staff come to the conclusion that a danger exists, on the basis of the size and shape of the sensed or imaged objects, the individual is labeled while still proceeding singly, before entering the vestibule 30. The labeling can be done without being noticed at all, by means of a gas jet or spray from a spray can 7.

From the vestibule, access to the interior of the building is provided, e.g., by a revolving door 4 made of metal and bulletproof glass. Sensors 9 detect the labeled individual at entry into the revolving door 4 and detain the individual in isolation by locking the door in position. Now, by way of the loudspeaker 8, the individual can be told to empty pockets and briefcase and to hand over the suspect objects for identification, through a hatch 6. Then the door-locking mechanism 21 can be released.

(FIG. 1).

To supplement these procedures, at a suitable place in the passage 11 individuals may be required to fill out a form at a writing desk or window 12. The consequence is that every visitor must stop and put down handbags and briefcases 13, which allows extra time for a more detailed, object-related investigation, e.g. by radiography with an additional X-ray machine 24. Furthermore, inconspicuously installed suction equipment can be used to draw off gas samples and analyze them, e.g. for the presence of plastic explosive or intoxicant drugs.

The present state of X-ray technology enables flawless images to be obtained with a radiation dose so low that the possibility of a health risk to the radiographed individual can be ruled out with absolute certainty. This applies equally to pregnant women and to the possibility of genetic damage.

In a procedure independent of radiography, the face of each visitor can be documented, e.g. by means of a (video) camera 14. In principle it is possible to process the recorded facial image with a pattern-recognition program in a computer 15 and to compare it with the faces of known dangerous persons stored in a memory 16. An individual identified as dangerous in this way can then be detained even though no weapons are being carried. Furthermore, if desired it is possible to check whether the identity claimed by the individual matches the identity stored in the computer 15. A failure to match provides grounds to detain the individual for a further identity check even without the detection of weapons.

Another sequence of the procedural steps described above, or their distribution among several rooms or parts of the building, is expressly within the scope of the invention.

The method in accordance with the invention requires the following devices or apparatus for the individual stages:

Stage 1: The entering persons are made to proceed singly in the vestibule by a suitably dimensioned, inconspicuous constriction of the passageway 11, e.g. by railings 23 or other items of furniture. Elevators with small cabins are also suitable.

Stage 2: To detect metal objects a sensor 1 is used, which for example indicates changes in a magnetic field. Better results may be obtained with several metal detectors at different heights.

Stage 3: Here an X-ray machine 2 is employed. Whether a single-frame image is produced, or whether an X-ray camera, invisible behind a wall facing, accompanies the visitor for several meters (film-like image sequence), depends on the user's security requirements. It is especially effective to have an array of X-ray generators and sensors at different heights, in combination with display screens.

Stage 4: A writing desk 12 with forms to be filled out is provided, with stands 27 on either side on which hand baggage 13 can be set down. The hand baggage is radiographed by means of X-ray cameras 24, advantageously equipped with zoom optics. To draw off traces of gas from plastic explosives and intoxicant drugs, hidden suction equipment 17 is installed that sends the extracted air to a mass spectrograph 18 and/or biosensors.

Stage 5: The face/head of every suspect individual is photographed. For this purpose a (video) camera 14 is installed behind a half-silvered mirror 22. A computer 15 with image-recognition software, an image memory 16 with the photographs of dangerous persons, and an image-comparison monitor 19 are provided.

Stage 6: To label suspect individuals inconspicuously, a gas jet, spray or the like is used. The nozzle 7 (in some cases several of them) is usefully installed below belt level. The labeling process is triggered, for example, by interruption of a (infrared) light beam 26.

Stage 7: It is necessary to have a passage that can be inconspicuously blocked in both the entrance and the exit direction, e.g. a revolving door 4 made of bullet-proof glass or an elevator cabin. These contain a sensor 9 to detect the labeling, with signal transmitter and the locking mechanism 21. In addition, a loudspeaker/microphone installation 8 and in some cases an additional video camera 25 for documentation purposes are employed.

The observation room 5 for the security staff is equipped with the necessary optical and acoustic display, observation and recording devices 10, 18, 19 of the usual commercial construction.

All the equipment and devices mentioned for stages 1 to 9 are state of the art. Therefore a high standard of security can be relatively economically achieved, for endangered buildings, objects and hence also for people.

We claim:

1. Arrangement for the detection of armed persons seeking entry in buildings, for identifying the nature of the weapon and the individual, and for detaining the potential perpetrator of violence by surprise by a security staff, giving no opportunity for resistance, said arrangement comprising the combination of the following apparatus:

(a) an entrance region to the building including an entrance at one end, an exit at the other end, and an entrance hall therebetween;

(b) means for guiding the persons and cause them to pass singly through the entrance region (11), the entrance region is shaped and equipped with channeling walls, passages, items of furniture (23) and railings;

(c) at least one metal detector (1) near the entrance to detect metal objects that are brought in;

(d) at least one X-ray generator (2) with sensor (3) to identify and evaluate metal objects;

(e) at least one monitor (10) to analyze X-ray images from said X-ray generator;

(f) at least one gas-jet or spray device (7) with an infrared light beam (26) as a triggering device to label a suspect person;

(g) means for detaining single individuals at the end of the entrance hall including, a revolving door (4);

(h) at least one sensor (9) in the region of passage through the revolving door, with a pulse generator to detect the gas-jet or spray marking;

(i) pulse-controlled means (21) for locking and unlocking the revolving door position:

(j) a hatch (6) in the region of the revolving door; and (k) a loudspeaker/microphone means mounted in the region of the revolving door.

2. Arrangement to detect armed persons according to claim 1, including at least one writing desk.

3. Arrangement to detect armed persons according to claim 1, including at least one photography and video camera (14) to take a picture of the person.

4. Arrangement to detect armed persons according to claim 3, wherein the camera (14) is installed so as to be concealed, including means for concealing the camera behind a half-silvered mirror (22).

5. Arrangement to detect armed persons according to claim 1, including a computer (15) with image-recognition software and a memory for stored images (16).

6. Arrangement to detect armed persons according to claim 1, including at least one image-comparison monitor (19).

7. Arrangement to detect armed persons according to claim 1, including at least one gas sampling device (17) to take gas samples.

8. Arrangement to detect armed persons according to claim 1, including at least one analysis device (18) to detect traces of explosives and intoxicant drugs.

9. Arrangement to detect armed persons according to claim 1, wherein to determine the vertical position of a metal object several metal detectors (1) are disposed at different height levels.

10. Arrangement to detect armed persons according to claim 1, wherein to identify metal objects at one or more height levels, several X-ray generators (2) and sensors (3), with associated display units (10), are present at different heights.

11. Arrangement to detect armed persons according to claim 1, wherein to identify metal objects that have been detected at a particular height level, an adjustable-height X-ray installation (2, 3) is positioned after the metal detector.

12. Arrangement to detect armed persons according to claim 1, wherein the lockable revolving door (4) is made of bulletproof glass.

13. Arrangement to detect armed persons according to claim 1, wherein the loudspeaker/microphone means and the hatch (6) are so constructed and disguised that they are not visually detectable.

14. Arrangement to detect armed persons according to claim 1, including at least one video recorder (20) to record the monitor information for more detailed analysis by slow or single-frame playback.

15. Arrangement to detect armed persons according to claim 1, including a second X-ray installation (24) to radiograph items of baggage (13) that have been set down.

16. Arrangement to detect armed persons according to claim 1, including at least one video camera (25) to document the events in the entrance region.

* * * * *